US005938495A

United States Patent [19]

Ito

[11] Patent Number: 5,938,495

[45] Date of Patent: Aug. 17, 1999

[54] METHOD OF MANUFACTURING A FIELD EMISSION COLD CATHODE CAPABLE OF STABLY PRODUCING A HIGH EMISSION CURRENT

[75] Inventor: Fuminori Ito, Tokyo, Japan

[73] Assignee: NEC Corporation, Tokyo, Japan

[21] Appl. No.: 08/848,466

[22] Filed: May 8, 1997

[30] Foreign Application Priority Data

May 10, 1996 [JP] Japan ..... 8-116819

[51] Int. Cl.[6] ..... H01J 9/02

[52] U.S. Cl. ..... 445/24; 445/59

[58] Field of Search ..... 445/24, 40, 59

[56] References Cited

U.S. PATENT DOCUMENTS 5,735,721 4/1998 Choi ..... 445/24

FOREIGN PATENT DOCUMENTS

| | | | |
|---|---|---|---|
| 0 736 891 A1 | 3/1996 | European Pat. Off. | H01J 9/02 |
| 56-061733 | 5/1981 | Japan . | |
| 5-021002 | 1/1993 | Japan . | |
| 6-089651 | 3/1994 | Japan . | |
| 7-147130 | 6/1995 | Japan . | |

OTHER PUBLICATIONS

Spindt et al., "Physical Properties of Thin–Film Field Emission Cathodes With Molybdenum Cones", *Journal Of Applied Physics*, vol. 47(12):pp. 5248–5263, (1976).

Bauer et al., "The Interaction of Oxygen With The Mo(100) Surface", *Surface Science*, vol. 88:31–59, (1979) pp. 31–59.

Floquet et al., "Superficial Oxidation Of Molybdenum At High Pressure And Low Temperature: RHEED and AES Analyses Of The Molybdenum Oxide Formation", *Surface Science*, vol. 251/252:1044–1049, (1991) pp. 1044–1049.

H.S. Kim and M.L. Yu, "Oxygen processed field emission tips for microcolumn applications", *Journal of Vacuum Science & Technology B*, vol. 11 (6), Nov./Dec. 1993, pp. 2327–2331.

P.R. Schwoebel and C.A. Spindt, "Field–emitter array performance enhancement using hydrogen glow discharges", *Applied Physics Letters*, Lett. 63(1), Jul. 5, 1993, pp. 33–35.

*Primary Examiner*—Sandra O'Shea
*Assistant Examiner*—Gene H. Rhodes
*Attorney, Agent, or Firm*—Foley & Lardner

[57] ABSTRACT

In a method of manufacturing a field emission cold cathode which has an emitter chip (25) of a metal material on a conductive layer (21) and is placed in a predetermined vacuum, a protection film (26) is formed on the emitter chip to prevent an unfavourable layer from being formed directly on the emitter chip. The protection film is removed from the emitter chip at a time when the field mission cold cathode is placed in the predetermined vacuum. On the conductive layer, an insulation layer (22) and a gate electrode layer (23) are formed to define a cavity (24). In the cavity, the emitter chip is formed on an exposed surface (21*a*) of the conductive layer.

10 Claims, 3 Drawing Sheets

METHOD OF MANUFACTURING A FIELD EMISSION COLD CATHODE CAPABLE OF STABLY PRODUCING A HIGH EMISSION CURRENT

BACKGROUND OF THE INVENTION

This invention relates to a field emission cold cathode and, in particular, to a method of manufacturing the same.

A field emission cold cathode is known as an electron source of an electron gun for use in a cathode ray tube (CRT) or a flat display panel of a self-emission type.

Such a field emission cold cathode comprises a cathode chip or an emitter chip known in the art. After the cathode chip is formed, the field emission cold cathode is exposed to the atmosphere during transfer to a subsequent step or during execution of the subsequent step. Therefore, it is assumed that an oxygen or a carbon-based gas contained in the atmosphere is adsorbed onto the cathode chip through a surface thereof. This results in producing an unfavourable layer along the surface of the cathode chip.

Generally, field emission known in the art has an electron emission characteristic greatly dependent upon the work function of the surface of the cathode chip. When adsorbed onto the surface, the oxygen or the carbon-based gas fluctuates the work function. Under the circumstances, the field emission cold cathode suffers decrease of emission current and increase of current fluctuation, if it is exposed in the atmosphere. Therefore, it is required to clean the surface of the cathode chip.

In order to clean the surface of the high-melting-point metal material, use can be made of a relatively simple method in which high-temperature heat treatment is carried out in a high vacuum at a heat treatment temperature not lower than 1500° C. However, the relatively simple method can not be applied to manufacture of the field emission cold cathode. This is because the heat treatment temperature has an upper limit strictly restricted on the reason which will later be described in conjunction with the drawings. Accordingly, it is disadvantageous that the surface of the cathode chip can not be completely cleaned.

SUMMARY OF THE INVENTION

It is therefore an object of this invention to provide a method of manufacturing a field emission cold cathode, in which the surface of the cathode chip is cleaned without carrying out high-temperature heat treatment.

It is another object of this invention to provide a method of manufacturing a field emission cold cathode of the type described, which is capable of stably producing a high emission current.

Other objects of this invention will become clear as the description proceeds.

A method to which this invention is applicable is of manufacturing a field emission cold cathode placed in a predetermined vacuum. The method comprises the steps of forming an insulation layer and a gate electrode layer on a conductive layer, locally removing the gate electrode layer and the insulation layer to expose as an exposed surface a part of the conductive layer, forming an emitter chip of a metal material on the exposed surface. The method further comprises the steps of forming a protection film on the emitter chip to prevent an unfavourable layer from being formed directly on the emitter chip, and removing the protection film from the emitter chip at a time when the field emission cold cathode is placed in the predetermined vacuum.

DESCRIPTION OF THE PREFERRED EMBODIMENT

Figure 1:
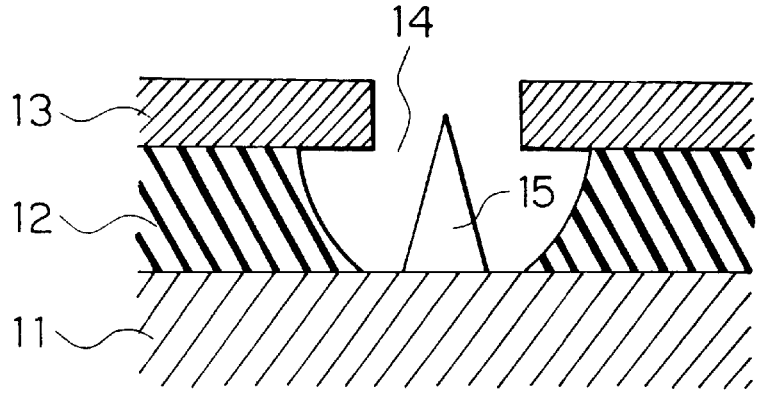
FIG. 1 PRIOR ART
FIG. 1 is a sectional view of a conventional field emission cold cathode.

Referring to FIG. 1, a conventional method of manufacturing a field emission cold cathode will be described for better understanding of the present invention. The field emission cold cathode comprises a conductive layer 11, an insulation layer 12, and a gate electrode layer 13 successively stacked in this order. A cavity 14 is formed in the gate electrode layer 13 and the insulation layer 12 to expose, as an exposed surface, a part of the conductive layer 11 in the cavity 14. Then, a sharp-pointed cathode chip or an emitter chip 15 is formed on the exposed surface of the conductive layer 11. Generally, the field emission cold cathode is manufactured by the use of the semiconductor fine processing technique known in the art.

The cathode chip 15 of the field emission cold cathode is often made of a material such as high-melting-point metal, carbide, or boride. Among others, molybdenum (Mo) known as a high-melting-point metal material is widely used because the emission current density is high and the controllability is excellent. Formation of the cathode chip 15 by the use of molybdenum is typically carried out by vapor deposition or sputtering in a high vacuum, as proposed by Spindt et al in "Physical properties of thin-film field emission cathodes with molybdenum cones", Journal of Applied Physics, Vol. 47, No. 12 (December 1976), page 5248.

After the cathode chip 15 is formed, the field emission cold cathode is exposed to the atmosphere during transfer to a subsequent step or during execution of the subsequent step. Therefore, an oxygen or a carbon-based gas contained in the atmosphere is adsorbed onto the surface of the cathode chip. Typically, the oxygen forms an oxygen-absorbed layer in cooperation with molybdenum in the manner known in the art. The oxygen-absorbed layer comprises $MoO/MoO_2$ sections 16 and $MoO_3$ sections 17 which are on the emitter chip 15 as depicted by white circles and black dots in FIG. 2A.

In the manner known in the art, it is relatively readily possible to desorb the $MoO_3$ sections 17 by carrying out heat treatment at a relatively low temperature. However, it is difficult to desorb the $MoO/MoO_2$ sections 16. Therefore, the $MoO/MoO_2$ sections 16 are left as an unfavourable layer directly on the surface of the emitter chip 15 even if the heat treatment is carried out.

In order to clean the surface of the high-melting-point metal material, use can be made of a relatively simple method in which high-temperature heat treatment is carried out in a high vacuum at a heat treatment temperature not lower than 1500° C. However, the conductive layer 11, the insulation layer 12, and the gate electrode layer 13 integrally formed into the field emission cold cathode have different melting points and different thermal expansion coefficients.

Figure 2A:
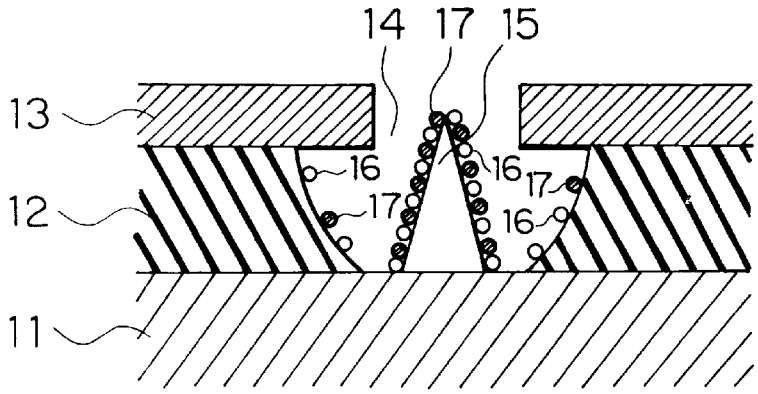
FIG. 2A PRIOR ART
FIGS. 2A and 2B are views for describing disadvantages of the conventional field emission cold cathode illustrated in FIG. 1.
Figure 2B:
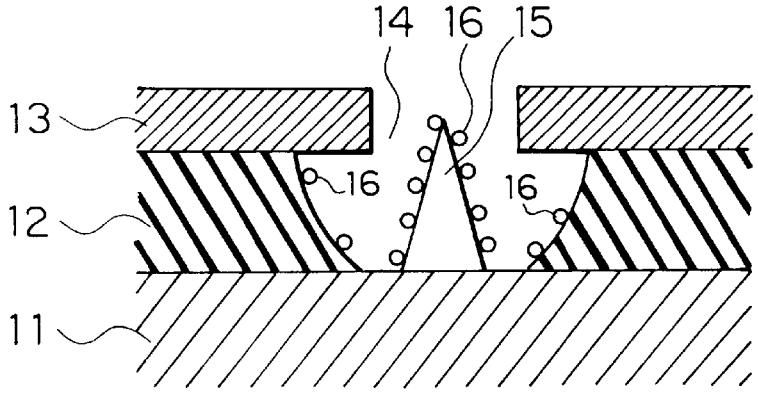
FIG. 2B PRIOR ART

This means that the upper limit of the heat treatment temperature is strictly restricted. For example, it is assumed that the conductive layer 11, the insulation layer 12, and the gate electrode layer 13 comprise silicon, silicon oxide, and molybdenum having melting points of 1300° C., 1000° C. and 2600° C., respectively. Therefore, the high-temperature heat treatment can not be carried out beyond a temperature range lower than 1000° C. Since the heat treatment temperature in the high-temperature heat treatment is restricted as described above, it is difficult to desorb the $MoO/MoO_2$ sections 16 which are stable in the above-mentioned temperature range. As illustrated in FIG. 2B, the $MoO/MoO_2$ sections 16 are left on the surface of the cathode chip 15. As a result, the surface of the cathode chip 15 of the field emission cold cathode can not be completely cleaned.

Figure 3A:
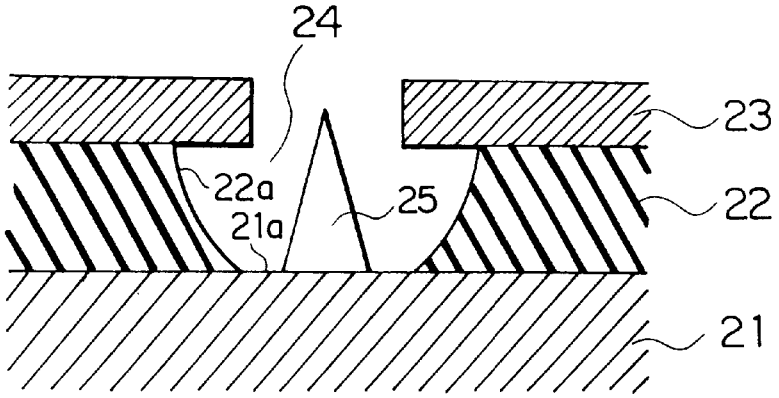
FIGS. 3A through 3C are views for describing a method of manufacturing a field emission cold cathode according to an embodiment of this invention.
Figure 3B:
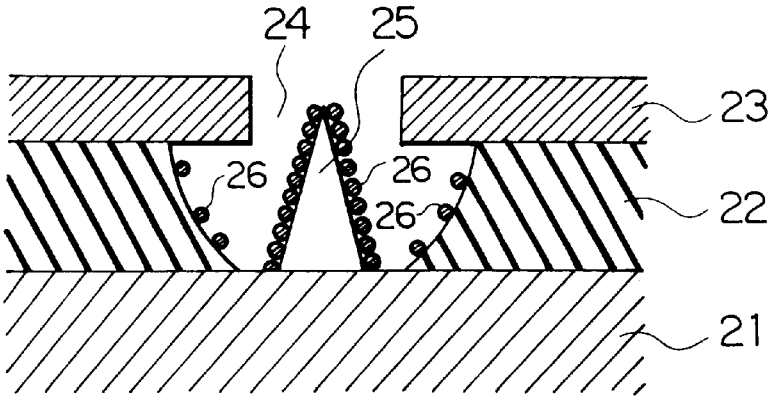
Figure 3C:
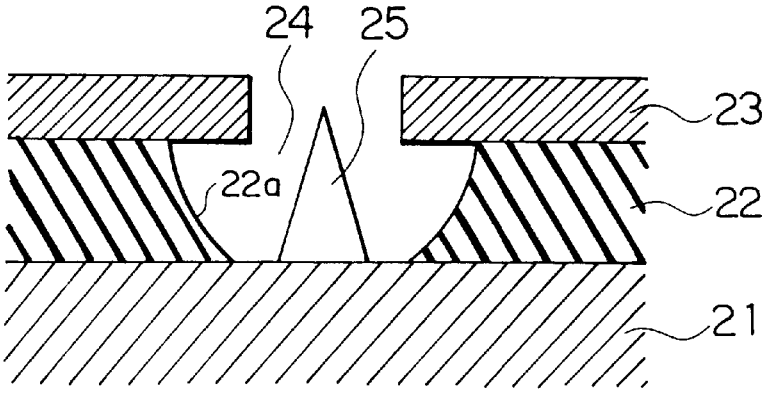

Turning to FIGS. 3A through 3C, description will be made as regards a method according to an embodiment of this invention, the method being of manufacturing a field emission cold cathode.

Referring to FIG. 3A, a heavily-doped n-type conductive layer or silicon substrate 21 is prepared at first. On the conductive layer 21, an insulation layer 22 of silicon dioxide ($SiO_2$) is deposited to have a thickness of 500 nm. Then, a gate electrode layer 23 of molybdenum (Mo) is deposited on the insulation layer 22 to have a thickness of 200 nm. An aperture having a diameter of 600 nm is formed in the gate electrode layer 23. The insulation layer 22 is etched through the aperture in the manner known in the art. As a consequence, a cavity 24 is formed in the insulation layer 22 to expose a part of the conductive layer 21 as an exposed surface 21*a*. Thereafter, on the exposed surface 21*a* of the conductive layer 21 in the cavity 24, a cathode chip or an emitter chip 25 of molybdenum is formed by vacuum deposition or sputtering in a vacuum chamber (not shown). In this event, it is assumed that the molybdenum is adhered to a slope surface 22*a* of the insulation layer 22.

The above-mentioned steps can be carried out by the conventional method proposed by Spindt et al as described with reference to FIGS. 2A and 2B. As a result of carrying out the above-mentioned steps, an cathode element is produced as illustrated in FIG. 3A. The cathode element will hereafter be referred to as a field emission device.

After the cathode chip 25 is formed in the cavity 24 as described above, the field emission device is immediately placed in an oxygen atmosphere on the order of $10^4$ Pa and heated to a temperature between 350° C. and 500° C. As a result of this oxidizing step, an oxide film is formed as a protection film on the surface of the cathode chip 25, as illustrated in FIG. 3B. The oxide film or the protection film comprises $MoO_3$ sections 26 which are depicted by black dots and will be collectively referred to as an $MoO_3$ film. In this connection, similar $MOo_3$ sections are formed on the slope surface 22*a* of the insulation layer 22. The latter $MoO_3$ sections are also designated by the reference numeral 26 and depicted by the black dots.

In order to avoid the surface of the cathode chip 25 from being exposed to the atmosphere, the oxidizing step is carried out by introducing hot oxygen gas into the same chamber where the preceding steps have been carried out to produce the field emission device. Alternatively, the oxidizing step is carried out by conveying the field emission device to an oxygen treatment vacuum chamber coupled through a gate valve to the above-mentioned chamber where the field emission device has been produced. The condition of forming the oxide film is determined with reference to N. Floquet et al "Superficial oxidation of molybdenum at high pressure and low temperature: RHEED and AES analyses of the molybdenum oxide formation", Surface Science Vol. 251/252 (1991), page 1044. The Floquest et al paper describes the condition of selective growth of $MoO_3$ oxide on Mo(100), Mo(110), and Mo(111) planes.

It is known that $MoO_3$ oxide is highly volatile. In E. Bauer et al "The interaction of oxygen with the Mo(100) surface", Surface Science, Vol. 88 (1979), page 31, it is reported that $MoO_3$ on a Mo(100) plane is desorbed in an ultra high vacuum at a relatively low temperature on the order of 500° C. Herein, the cathode chip 25 formed by vacuum deposition or the like has a polycrystalline structure with random orientation and is not a single crystal as described in the above-referenced article. However, it has been experimentally confirmed by the present inventors that $MoO_3$ formed on the surface of the cathode chip 25 of such a polycrystalline structure can be removed by heat treatment at a relatively low temperature, like $MoO_3$ on the surface of the single crystal.

Thereafter, the field emission device is mounted in an apparatus such as a CRT, a self-emission flat display panel, or the like, as will later be described. The mounting process includes a degassing step. In the degassing step, the $MoO_3$ sections 26 on the surface of the cathode chip 25 is heated in a vacuum. Therefore, by the degassing step, the $MOO_3$ sections 26 are desorbed from the surface of the cathode chip 25, so that the surface of the cathode chip 25 is cleaned as illustrated in FIG. 3C.

Simultaneously, desorption of $MoO_3$ also takes place on the slope surface 21*a* of the insulation layer 22 where molybdenum has been adhered during formation of the cathode chip 25 and then oxidized to form the $MoO_3$ sections 26. Therefore, current leakage between the conductive layer 21 and the gate electrode layer 23 can be suppressed to avoid deterioration of a breakdown voltage.

Figure 4:
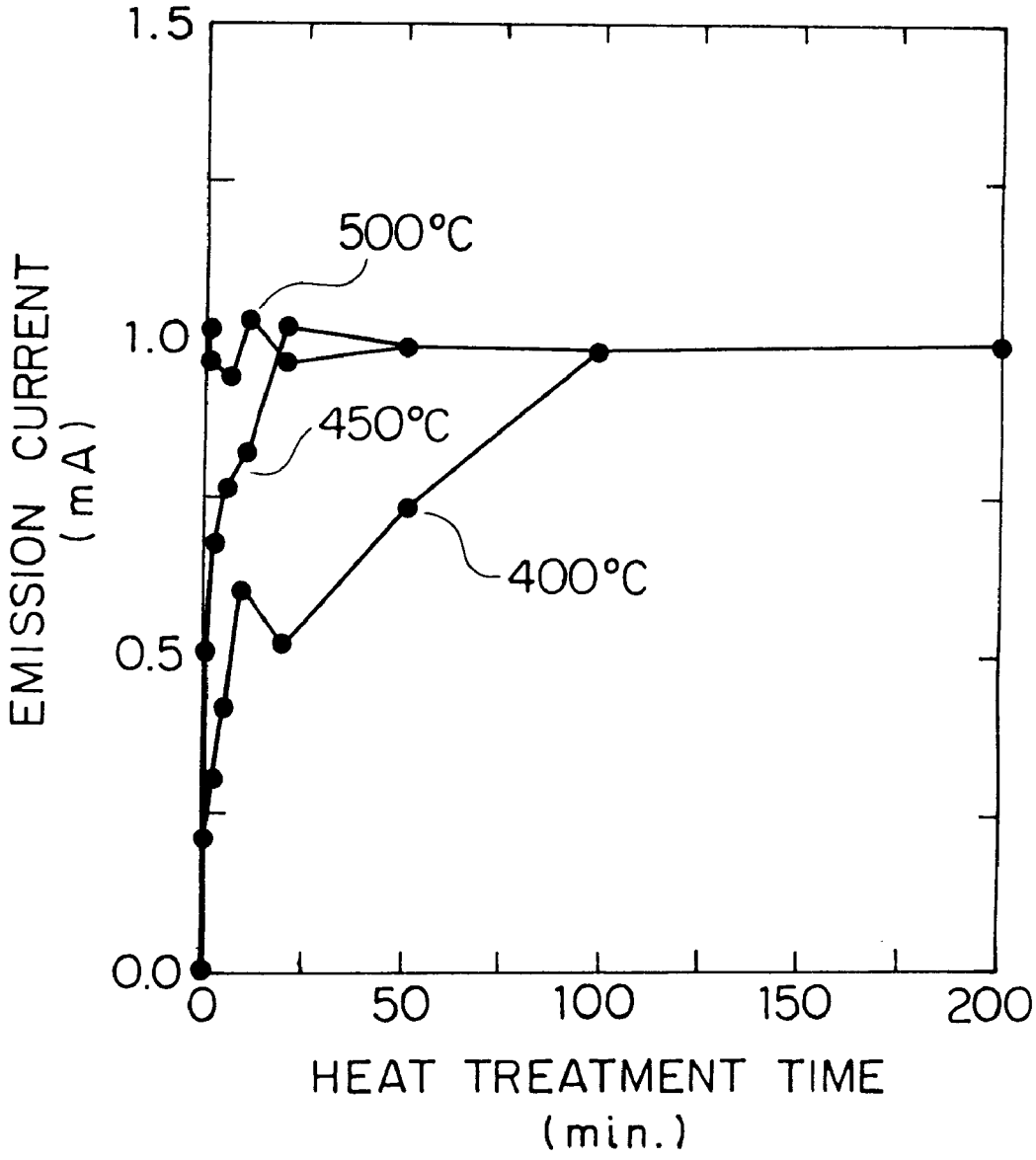
FIG. 4 is a graph showing relationship between an emission current of the field emission cold cathode of this invention and a heat treatment time of a cathode chip with a $MoO_3$ film formed thereon.

FIG. 4 shows, as an experimental result, the relationship between the emission current of the field emission device and the heat treatment time of the cathode chip 25 with the $MoO_3$ sections 26 formed thereon. The heat treatment was carried out at different temperatures of 400° C., 450° C., and 500° C. For the temperatures 400° C., 450° C., and 500° C., increase of the emission current is saturated after lapse of at least 100 minutes, 10 minutes, and one minute, respectively. The desorption of the $MoO_3$ sections 26 during the heat treatment was confirmed by the use of a mass spectrograph.

As is obvious from FIG. 4, the desorption of the $MoO_3$ sections 26 by the heat treatment can be completed in a shorter time if the heat treatment is carried out at a higher temperature. However, the temperature of the heat treatment must not exceed a temperature range acceptable by the field emission device as a whole. In the embodiment described above, the conductive layer 21, the insulation layer 22, and the gate electrode layer 23 are formed by silicon, silicon oxide, and molybdenum having melting points of 1300° C., 1000° C., and 2600° C., respectively. Taking into consideration these melting points and the margin corresponding to the difference in thermal expansion coefficient among the above-mentioned materials, the heat treatment temperature is restricted by the upper limit of about 800° C. In addition, when the field emission device is mounted in a predetermined apparatus by the use of wires of a low-melting-point material, for example, an aluminum alloy material, the melting point of the wires must also be taken into consideration. As a result, the heat treatment temperature is further restricted to be lower than about 500° C.

At the room temperature, the $MoO_3$ sections 26 are not desorbed in a short time and therefore serves as a protection film for the cathode chip 25 when the field emission device is exposed to the atmosphere during transfer to a subsequent step or during execution of the subsequent step. In other words, the $MoO_3$ sections 26 serve to prevent the formation of a MoO or $MoO_2$ which is stable even in a relatively high temperature and can only be desorbed at the temperature as high as 1500° C. or more.

Finally, description will be made as regards the case where the field emission device is mounted in the predetermined device. At first, when the field emission device is mounted in the CRT (Cathode Ray Tube) as a CRT electron gun, the field emission device is mounted on a predetermined package and fixedly connected thereto by the use of conductive silver paste (epoxy resin). Solidification or curing of the conductive silver paste requires heat treatment at about 150° C. Since this heat treatment is completed in a short time, the $MoO_3$ sections 26 on the surface of the cathode chip 25 is not desorbed at this stage. Thereafter, the field emission device mounted on the package is confined within the CRT. At this time, the inside of the CRT is pumped to vacuum by the use of an oil diffusion pump or the like and subjected to the degassing step at a temperature around 400° C. By this degassing step, the $MoO_3$ sections 26 on the surface of the cathode chip 25 is desorbed from the cathode chip 25 so that the surface of the cathode chip 25 is cleaned.

Consideration will be made about the case where the field emission device is mounted in a self-emission flat display panel. In this event, a number of the field emission devices are arranged in a flat plane. If a glass substrate is used as a panel substrate, the heat resistant temperature is restricted below 600° C. which is a softening point of the glass. In the flat display panel also, the degassing step is carried out at a temperature around 400° C. so as to keep a high vacuum within the panel. Thus, the surface of the cathode chip 25 is cleaned simultaneously with the degassing step, in the manner similar to that described in conjunction with the CRT.

As described above, in this embodiment, the degassing step also serves as a removing step. Therefore, the surface of the cathode chip 25 can be cleaned without requiring any additional desorption step. As a result, high emission current is stably obtained.

In case where the temperature and the time of the degassing step are not sufficient to desorb the $MoO_3$ sections 26, an additional heating step is required prior to start of electron emission.

While the present invention has thus far been described in connection with a single embodiment thereof, it will readily be possible for those skilled in the art to put this invention into practice in various other manners. For example, this invention is also applicable to the cathode chip made of a different material. In this case also, a compound such as oxide or nitride which can be removed by heat treatment in a vacuum at a relatively low temperature (acceptable by the field emission device) is formed on the surface of the cathode chip.

What is claimed is:

1. A method of manufacturing a field emission cold cathode placed in a predetermined vacuum, said method comprising the steps of forming an insulation layer and a gate electrode layer on a conductive layer, locally removing said gate electrode layer and said insulation layer to expose as an exposed surface a part of said conductive layer, forming an emitter chip of a metal material on said exposed surface, said method further comprising the steps of:

forming a protection film on said emitter chip by reacting said metal material in a reacting atmosphere to prevent an unfavourable layer from being formed directly on said emitter chip; and removing said protection film from said emitter chip at a time when said field emission cold cathode is placed in said predetermined vacuum.

2. A method as claimed in claim 1, wherein said protection film is made of particular material which can be desorbed from said emitter chip by being heated in a given vacuum at a given temperature, the last-mentioned removing step comprising the step of heating said protection film in said given vacuum at said given temperature to desorb said particular material from said emitter chip at a time when said field emission cold cathode is placed in said predetermined vacuum.

3. A method as claimed in claim 2, wherein said given temperature is included within a heat resistance range of a combination of said conductive layer, said insulation layer, said gate electrode layer, and said emitter chip.

4. A method as claimed in claim 2, wherein said given vacuum is determined equal to said predetermined vacuum.

5. A method of manufacturing a field emission cold cathode placed in a predetermined vacuum, said method comprising the steps of forming an insulation layer and a gate electrode layer on a conductive layer, locally removing said gate electrode layer and said insulation layer to expose as an exposed surface a part of said conductive layer, forming an emitter chip of a metal material on said exposed surface, said method further comprising the steps of:

forming a protection film on said emitter chip to prevent an unfavourable layer from being formed directly on said emitter chip, wherein said protection film is an oxide film or a nitride film; and removing said protection film from said emitter chip at a time when said field emission cold cathode is placed in said predetermined vacuum.

6. A method as claimed in claim 5, wherein the last-mentioned forming step comprises the steps of:

locating at least said emitter chip in a vacuum chamber;

introducing one of oxygen gas and nitrogen gas into said vacuum chamber; and heating at least said emitter chip.

7. A method as claimed in claim 6, wherein said emitter chip is formed within said vacuum chamber.

8. A method as claimed in claim 6, wherein said vacuum chamber is coupled through a gate valve to another vacuum chamber in which said emitter chip is formed.

9. A method as claimed in claim 1, wherein said emitter chip comprises molybdenum, the last-mentioned forming step comprising a step of oxidizing said emitter chip to produce an $MoO_3$ film as said protection film on said emitter chip.

10. A method as claimed in claim 1, wherein said field emission cold cathode is located in a cathode ray tube in which said predetermined vacuum is determined, the last-mentioned removing step being carried out within said cathode ray tube.

* * * * *